United States Patent [19]

Bethmann et al.

[11] Patent Number: 4,519,316

[45] Date of Patent: May 28, 1985

[54] AMMUNITION, PREFERABLY FOR MACHINE CANNONS, INCLUDING A PROJECTILE EQUIPPED WITH A TRACER, WITH THE LETHAL RANGE OF THE PROJECTILE BEING LIMITED IF THE TARGET IS MISSED

[76] Inventors: Karl W. Bethmann, Gellertstrasse 15, D-4130 Moers 1; Ulrich Theis, Kuhlendahl 92, D-4330 Mülheim/Ruhr, both of Fed. Rep. of Germany

[21] Appl. No.: 444,324

[22] Filed: Nov. 24, 1982

[30] Foreign Application Priority Data

Nov. 25, 1981 [DE] Fed. Rep. of Germany ..... 3146645

[51] Int. Cl.[3] ..... F42B 11/16

[52] U.S. Cl. ..... 102/513; 244/3.1; 244/3.24

[58] Field of Search ..... 102/513, 520–523, 102/529, 501; 244/3.3, 3.1, 3.24–3.29

[56] References Cited

U.S. PATENT DOCUMENTS

| | | | |
|---|---|---|---|
| 3,361,066 | 1/1968 | Gawlick | 102/513 |
| 3,882,782 | 5/1975 | Simmen . | |
| 4,195,573 | 4/1980 | Leeker et al. . | |
| 4,215,632 | 8/1980 | Sie | 102/529 X |
| 4,362,107 | 12/1982 | Romer et al. | 102/529 X |

FOREIGN PATENT DOCUMENTS

| | | | |
|---|---|---|---|
| 49651 | 11/1919 | France | 244/3.3 |
| 2089946 | 6/1982 | United Kingdom | 102/529 |

*Primary Examiner*—Harold J. Tudor
*Attorney, Agent, or Firm*—Spencer & Frank

[57] ABSTRACT

In ammunition, preferably for machine cannons, including a subcaliber stabilized projectile equipped with a body of tracer material and a stabilizing element, the heat released during combustion of the tracer material is utilized to drastically change the strength of the material of an element used to fasten the stabilizing element to the projectile. By being able to set the time of combustion and of the change in the material, the stabilizing element changes its position with respect to the projectile. The system or ammunition in question becomes unstable and drops to the ground.

10 Claims, 5 Drawing Figures

AMMUNITION, PREFERABLY FOR MACHINE CANNONS, INCLUDING A PROJECTILE EQUIPPED WITH A TRACER, WITH THE LETHAL RANGE OF THE PROJECTILE BEING LIMITED IF THE TARGET IS MISSED

BACKGROUND OF THE INVENTION

The invention relates to ammunition, preferably for machine cannons, including a projectile, which is provided with a tracer and a stabilizing element, and whose lethal range is limited when a target is missed.

Ammunition of the above-mentioned type is customarily employed to substantially avoid inadvertent damage outside a given region from a projectile that missed its target. If a flying target is involved, the projectile could endanger friendly ground troops. This applies for ground-to-air combat as well as for air-to-air combat.

Spin stabilized explosive projectiles have an explosive charge and an impact detonator. The impact detonator is provided with means which permit the detonator to become effective if the spin of the projectile falls below a given value. The explosive charge is then used to self-destruct the projectile and thus limits its lethal range. Such a detonator is known from U.S. Pat. No. 3,882,782. Explosive projectiles are customarily of full caliber. Therefore they have a large flow cross section. Consequently they are subject to annoying deceleration. By comparison, their path of flight is therefore considerably curved. They are thus essentially unsuitable to combat fast flying targets (low-flying aircraft and guided missiles) and extremely maneuvrable flying targets (combat helicopters). Since the above-mentioned targets frequently have structured and multilayer regions, the effectiveness of explosive projectiles is significantly limited here as well. The manner in which the above-mentioned targets are used, necessitates combatting them with machine weapons which, with high cadence and fast directiveness, have the greatest direct hit probability.

In the field of use in question, the high density subcaliber projectile is consequently the selected means. It has an elongated flight path. The drawback here is the need for a self-destruct charge because such charge and the means to actuate it adversely affect the average density of the projectile.

SUMMARY OF THE INVENTION

It is the object of the invention to make available an ammunition of the above-mentioned type which is simple and reliable and, due to the greatest possible density of the projectile, leads to an elongated flight path.

This is accomplished by the invention in that in a projectile, which is provided with a tracer and with a stabilizing element and whose lethal range is limited when a target is missed, the projectile is a subcaliber projectile; the stabilizing element is fastened to the projectile by means of a body of consumable material whose consumption can be timed; and the consumption of the material is caused by the heat generated by the burning of the tracer material during flight of the projectile and causes the stabilizing element to change its original position, whereby the projectile becomes ballistically unstable. The invention will be explained in greater detail below with the aid of two preferred embodiments for a spin stabilized and a fin stabilized projectile, both illustrated in the drawing. The technical principle of the solution will thus become evident while details not significant for the invention are omitted.

In connection with fin stabilized projectiles, reference is made to U.S. Pat. No. 4,195,573. This patent relates to a subcaliber arrow-shaped projectile having a resistance stabilizing tail section. The latter is designed as a conus having at least two bores disposed outside the projectile diameter. These bores themselves may be designed in a convergent-divergent manner as supersonic diffusors so as to limit the range of the projectile. In a high Mach number range, the bores offer little flow constriction. If the velocity drops below a given value, the so-called blocking effect results in a significant increase in resistance. A rapid onset of deceleration of projectile movement leads to a limitation of the range of the projectile so that the arrangement, which can be called a perforated cone tail section, is suitable particularly for use as practice projectile on firing ranges of limited expanse. However, for projectiles in the caliber range in question for machine cannons, a perforated cone tail section is unsuitable. Due to the required size of its bore, the diameter of the cone must be so large that it can be used only in larger caliber tubular weapons, for example armored cannons.

Compared to the velocity dependent perforated cone tail section, the limitation of the lethal range in ammunition according to the invention is exclusively a function of time.

Advantageously, such time dependence can be provided with simple means and within wide limits.

DETAILED DESCRIPTION OF THE PREFERRED EMBODIMENTS

Figure 1:
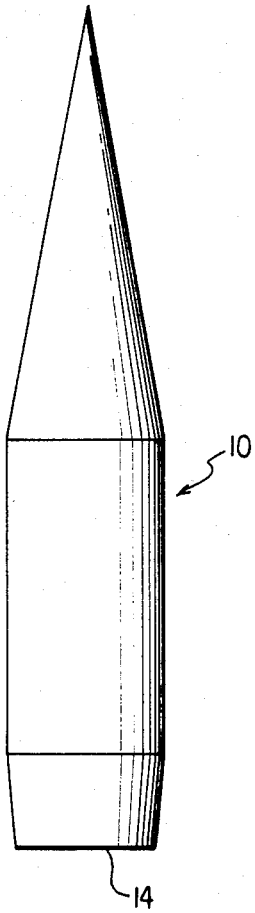
FIG. 1 is an elevational view of a twist or spin stabilized subcaliber projectile.
Figure 1A:
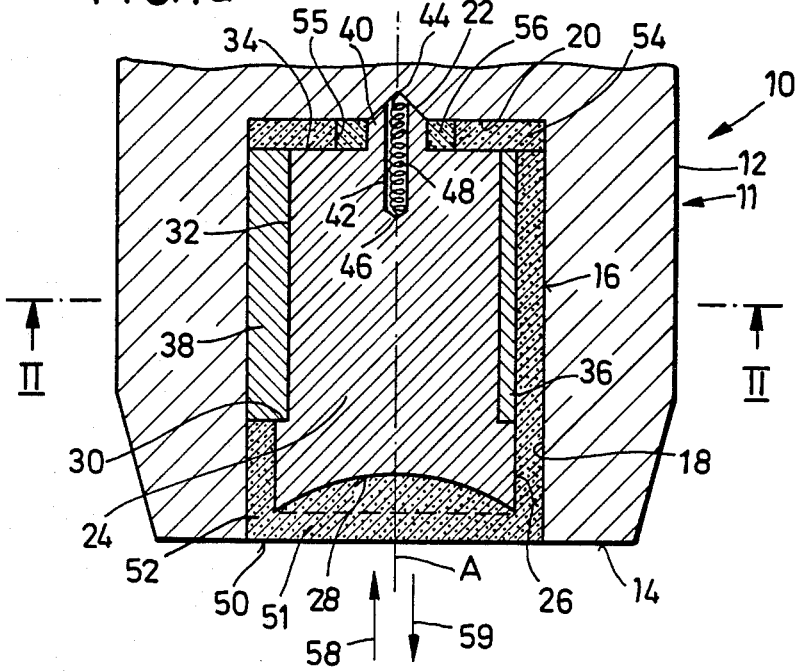
FIG. 1*a* is a longitudinal, axial sectional view to a larger scale of the tail section of the projectile according to FIG. 1 equipped with the invention.
Figure 2:
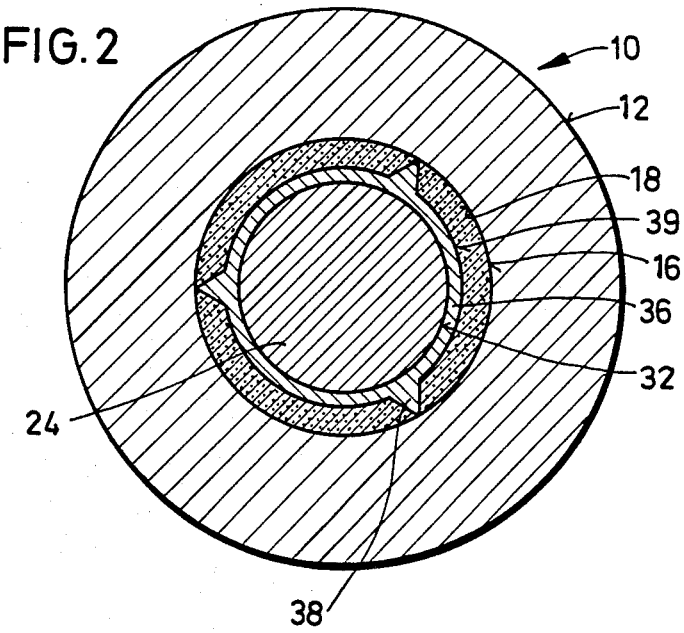
FIG. 2 is a cross-sectional view of the device along line II—II of FIG. 1*a;*

According to FIGS. 1*a* and 2, the tail section 11 of a projectile body 10 of a spin stabilized projectile according to FIG. 1 has a circumferential face 12 and a tail face 14, with a rear bore 16 having a circumferential face 18 and a frontal face 20. In the region of a central longitudinal axis A, a funnel-shaped centering bore 22 is disposed in the frontal face 20 of projectile body 10. An essentially circularly cylindrical stabilizing body 24 is provided in the bore 16 with the body 24 having a rear circumferential face 26, a concave tail face 28, and a front circumferential face 32 with a smaller diameter than circumferential face 26. Between the front circumferential face 32 and the rear circumferential face 26, there is provided a radial step 30. A frontal face 34 of the stabilizing body 24 is provided with a centering projection 40 having a central bore 42. The centering projection 40 adapts itself to the centering bore 22. The stabilizing body 24 has a jacket 36 which surrounds circumferential face 36 and extends in a longitudinal axial direction between projection or radial step 30 and frontal face 34, and which has three centering ribs 38 which project radially outwardly toward the circumferential face 18 of the bore 16. The space created between the outer circumferential face 39 of the jacket 36 and the circumferential face 18 of the bore 16, between the rear circumferential face 26 of the body 24 and the circumferential face 18 of bore 16, as well as between both frontal faces 20 and 23 serves to accommodate an annular disc 54 and a circularly cylindrical hollow body 52 of a tracer material 50. The projection 40 is enclosed by an annular disc 56 which is made of a substance to be discussed below and is in intimate contact with cylinder face 55 of annular disc 54. In the region in question, the circularly cylindrical hollow body 52 is interrupted by the centering ribs 38. The rearward delimitation of the tracer material 50 is formed by a member 51 which fills the space between the tail face 28 and an edge of bore 16 which lies in tail face 14. A coiled wire 48 is accommodated in the central bore 42. The front end of the wire is fastened to a point 44 on the projectile body 10 and its rear end is fastened to a point 46 on the stabilizing body 24.

Figure 3:
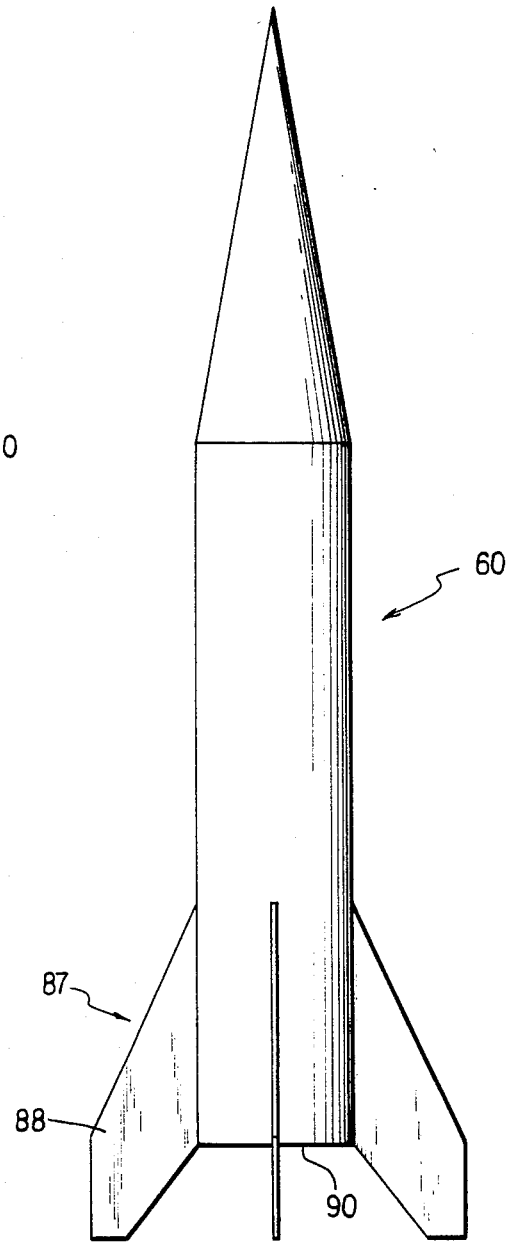
FIG. 3 is an elevational view of a fin stabilized subcaliber projectile.
Figure 3A:
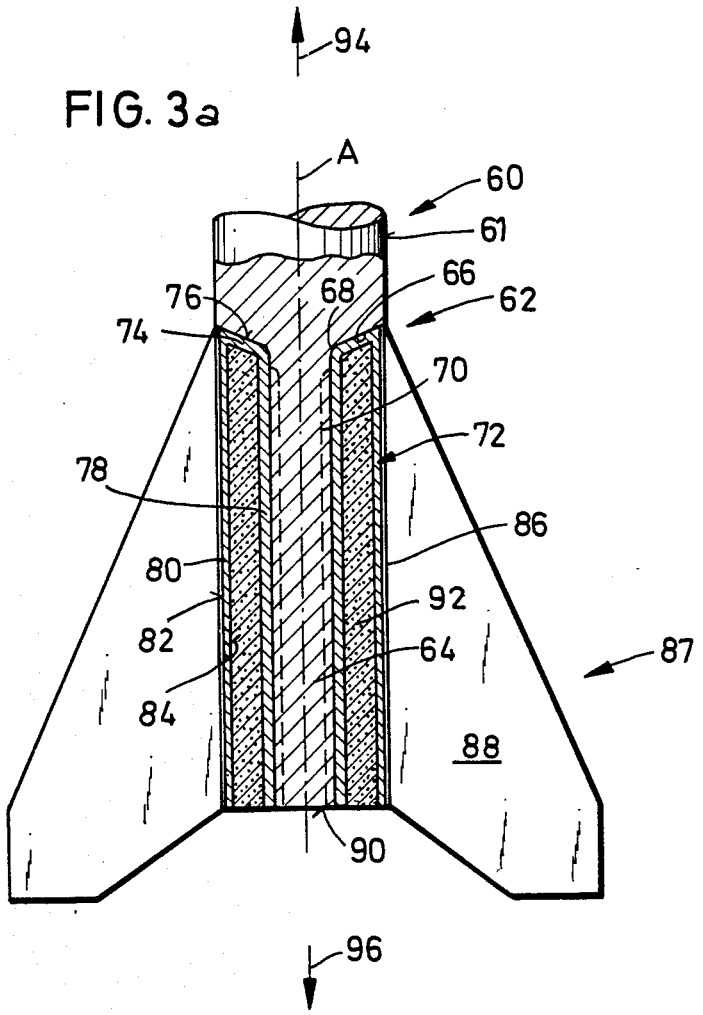
FIG. 3*a* is an enlarged view, partially in a longitudinal axial section, of the tail section of the projectile according to FIG. 3 equipped with the invention.

According to FIG. 3*a*, the projectile body 60 of a fin stabilized subcaliber projectile according to FIG. 3 has a tail section 62 having a circumferential face 61 and a central, axial supporting extension 64 having a comparatively small diameter. A bore face 66 connects, via a stress relief radius 68, the circumferential face 61 with the external thread 70 of the supporting extension 64. A double-walled sleeve 72 having a circularly cylindrical cross section encloses the supporting extension 64, the enclosure being form-locking due to the provision of a thread. A front wall 74 connects an interior wall 78 with an exterior wall 80 so that one outer frontal face 76 of front wall 74 is urged against bore face 66. The circumferential face 80 of sleeve 72 is connected, in a manner not shown in detail, with a thin walled sleeve 86 which, together with stabilizing fin 88 fastened thereto, forms a stabilizing tail section 87. A hollow space 84 between facing surfaces of interior wall 78 and exterior wall 80 of sleeve 72 serve as receptacle for a body of tracer material 92, the receptacle extending from front wall 74 to a tail face 90.

The effect of the invention will first be explained in connection with a spin stabilized projectile as shown in FIGS. 1, 1*a* and 2.

When the weapon is fired, the tracer material 50 is ignited, in a manner not to be explained in detail, in the region of tail surface 14. Together with member 51, the body 52 which encloses the stabilizing body 24 is also consumed. As soon as the combustion of the tracer material 50 has advanced to step 30, jacket 36 together with its centering ribs 38 begins to heat up. Jacket 36 is made of a material whose strength changes drastically due to the effect of the heat released by the burning tracer material 50. If the jacket 36 is made of an appropriate magnesium alloy, it loses its strength due to chemical reaction, i.e. preferably due to intensive oxidation, which corresponds to consumption by burning. In order to improve the penetration power of the projectile, stabilizing body 24 as well as projectile body 10 are made of a high density material, for example a sintered alloy containing a large amount of tungsten or deriched uranium. During the course of burning of the tracer material 50 and the jacket 96, the stabilizing body 24 progressively loses its fix in the bore 16. A suction in the direction of arrow 59—a direction opposite to the direction of flight 58 of the projectile—acts on the concave tail face 28 of the stabilizing body 24. Additionally, during the reaction transfer from member 54 of tracer material 50 to substance 56, a larger quantity of gas is released from the latter to press primarily onto frontal face 20 of projectile body 10 and frontal face 34 of the stabilizing body 24 so as to axially displace the latter in the direction of arrow 59. Pressure acting at the front and suction acting at the rear permit stabilizing body 24 to exit from bore 16. The connection between projectile 10 and stabilizing body 24 remains in effect via the unwinding wire 48. During this process, the respective system becomes ballistically unstable, leaves its flight path and drops downwardly. In this way, the lethal range of the respective missile is limited. The combustion of tracer material 50 and the consumption of jacket 36 can advantageously be timed within wide limits so that controlled limitation of the lethal range is provided in a simple and reliable manner. The time adjustability of the destabilization of the path of flight here depends on the given combat distance. Within that distance, the system remains stable so that, upon hitting a target, the total mass of projectile 10 and stabilizing body 24 becomes effective. Only if the combat distance is exceeded by missing the target, will there occur the described destabilization with its projectile range limiting effect.

The effect of the invention in a fin stabilized projectile according to FIGS. 3 and 3*a* will now be described:

Igniting of the tracer material 92 takes place in the region of the tail surface 90 as a function of firing of the weapon. The large quantity of heat released during combustion at high temperature is transferred to the interior wall 78 as well as to the exterior wall 80 of sleeve 72. While it is possible to substantially dissipate the heat to the environment through the exterior wall 80, sleeve 86 and stabilizing fins 88, a heavy accumulation of heat develops in the region of interior wall 78. This causes the material of interior wall 78 to soften. Consequently, as soon as the combustion of the body of tracer material 92 has progressed sufficiently far, the form locking connection between sleeve 72 and supporting extension 64 is lost. The stabilizing tail section 87 separates itself from projectile 60 in the direction of arrow 96 and opposite to the direction of flight 94 to directly cause the projectile to become unstable so that it leaves its original flight path and drops downwardly. The description of the adjustable timing for destabilization given in connection with the projectile according to FIGS. 1*a* and 2 applies here in an analogous manner.

Since stabilizing fins customarily are set at only a slight angle so as to produce a slight equalizing rotation, separation from the projectile is here additionally enhanced by the invention.

In proposed solutions, a self-destruct charge is to be initiated via a tracer after a given period of time. This involves considerable drawbacks: the self-destruct charge may be actuated already in the barrel and can thus seriously damage the weapon system or make it useless. The self-destruct charge must be accommodated in a central, axial bore; this bore reduces the penetration power of the projectile in armored targets. To assure a sufficient effect, the self-destruct charge must have a certain minimum size; this adversely affects the density of the projectile.

All of the drawbacks listed above are avoided with certainty by the invention. Even if the tracer material is faulty, the entire projectile leaves the barrel, and the weapon systems remains ready for use.

We claim:

1. In ammunition, preferably for machine cannons, including a projectile, equipped with a tracer and a stabilizing element, whose lethal range is limited when the target is missed, the improvement wherein:

(a) said projectile is a subcaliber projectile;

(b) said stabilizing element is fixed with respect to said projectile by means of a body of consumable material;

(c) the consumption of said material can be timed; and (d) said tracer is disposed adjacent said body of consumable material so that the consumption of said consumable material is caused by the heat generated by the burning of the tracer during flight of said projectile and causes said stabilizing element to change its original stabilizing position, whereby the projectile becomes ballistically unstable.

2. Apparatus according to claim 1, characterized by consumability as a result of preferably chemical change.

3. Apparatus according to claim 1, characterized by consumability as a result of preferably physical change.

4. Apparatus according to claim 1, 2 or 3 wherein said projectile is a spin stabilized projectile, and the stabilizing element is a body disposed in a bore at the rear of the projectile.

5. Apparatus according to claim 1, 2 or 3 wherein said projectile is a fin stabilized projectile, and the stabilizing element is a unit disposed at the tail of the projectile.

6. Apparatus according to claim 4 wherein: said body of consumable material is a jacket which extends along a portion of the length of said stabilizing element and has a plurality of outwardly extending centering ribs which contact the side wall of said bore; and the remainder of the space between said jacket and said side wall and between said stabilizing element and said side wall are filled with the material of said tracer.

7. Apparatus as defined in claim 6 further comprising means for causing said stabilizing element to be axially displaced out of said bore upon consumption of said material.

8. Apparatus as defined in claim 7 wherein the inner end of said stabilizing element is attached to said projectile by an elongated wire, whereby said stabilizing element remains attached to said projectile even after it leaves said bore.

9. Apparatus as defined in claim 5 wherein: said projectile has an axially extending solid extension at its rear surface; said stabilizing unit includes a hollow cylindrical body which coaxially surrounds said extension, and which has a plurality of outwardly extending fins; said body of consumable material includes spaced outer and inner cylindrical members disposed between and connected respectively to said hollow cylindrical member of said stabilizing unit and said extension, and a radially extending portion connecting said spaced outer and inner cylindrical members together at their respective inner ends; and the space between said outer and inner cylindrical members is filled with the material of said tracer.

10. Apparatus as defined in claim 9 wherein said extension is provided with an external thread which is threadingly engaged by the inner circumferential surface of said inner cylindrical member, whereby said body of consumable material, said tracer and said stabilizing unit are all threadingly connected to said axial extension.

* * * * *